US006997273B2

(12) United States Patent
Singh

(10) Patent No.: US 6,997,273 B2
(45) Date of Patent: Feb. 14, 2006

(54) BLUNT FACED CUTTER ELEMENT AND ENHANCED DRILL BIT AND CUTTING STRUCTURE

(75) Inventor: Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/295,343

(22) Filed: Nov. 15, 2002

(65) Prior Publication Data

US 2004/0094334 A1 May 20, 2004

(51) Int. Cl.
*E21B 10/52* (2006.01)
*E21B 10/58* (2006.01)

(52) U.S. Cl. ..... 175/430; 175/377

(58) Field of Classification Search ..... 175/327, 175/331, 377, 425, 426, 430, 428
See application file for complete search history.

(56) References Cited

U.S. PATENT DOCUMENTS

| | | | | |
|---|---|---|---|---|
| 3,442,352 | A | 5/1969 | McElya et al. | 175/374 |
| 4,056,153 | A | 11/1977 | Miglierini | 175/341 |
| 4,058,177 | A | 11/1977 | Langford, Jr. et al. | 175/374 |
| 4,086,973 | A | 5/1978 | Keller et al. | 175/374 |
| 4,108,260 | A | 8/1978 | Bozarth | 175/374 |
| 4,334,586 | A | 6/1982 | Schumacher | 175/374 |
| 4,716,977 | A | 1/1988 | Huffstutler | 175/410 |
| 4,722,405 | A | 2/1988 | Langford, Jr. | 175/374 |
| 4,832,139 | A | 5/1989 | Minikus et al. | 175/374 |
| 4,951,762 | A | 8/1990 | Lundell | 175/410 |
| 5,172,777 | A | 12/1992 | Siracki et al. | 175/374 |
| 5,172,779 | A | 12/1992 | Siracki et al. | 175/420 |
| 5,197,555 | A | 3/1993 | Estes | 175/431 |
| 5,201,376 | A | 4/1993 | Williams | 175/374 |
| 5,322,138 | A | 6/1994 | Siracki | 175/374 |
| 5,323,865 | A | 6/1994 | Isbell et al. | 175/378 |
| 5,341,890 | A | 8/1994 | Cawthorne et al. | 175/374 |
| 5,351,768 | A | 10/1994 | Scott et al. | 175/374 |
| 5,372,210 | A | 12/1994 | Harrell | 175/431 |
| 5,407,022 | A | 4/1995 | Scott et al. | 175/331 |
| 5,415,244 | A | 5/1995 | Portwood | 175/374 |
| 5,421,423 | A | 6/1995 | Huffstutler | 175/374 |
| 5,421,424 | A | 6/1995 | Portwood et al. | 175/374 |
| 5,429,200 | A | 7/1995 | Blackman et al. | 175/371 |
| 5,452,771 | A | 9/1995 | Blackman et al. | 175/353 |
| 5,479,997 | A | 1/1996 | Scott et al. | 175/374 |
| 5,518,077 | A | 5/1996 | Blackman et al. | 175/353 |
| 5,542,485 | A | 8/1996 | Pessier et al. | 175/371 |
| 5,592,995 | A | 1/1997 | Scott et al. | 175/374 |
| 5,636,700 | A | 6/1997 | Shamburger, Jr. | 175/331 |

(Continued)

FOREIGN PATENT DOCUMENTS

EP 0 527 506 A2 2/1993

*Primary Examiner*—Jennifer H Gay
(74) *Attorney, Agent, or Firm*—Conley Rose, P.C.

(57) ABSTRACT

The cutter element includes a rounded apex offset from the center line of the insert and having a relatively broad and blunt front face and a narrower, more rounded rear face. The cutter element may be disposed in the outermost inner row of a rolling cone cutter of a bit with the broader front face facing the borehole side wall so as to resist off center wear and resultant bit whirl. When placed in inner rows and oriented with the broader and flatter front face being the first portion of the cutting surface to engage the borehole, enhancements in bit durability may be achieved, particularly when drilling through formations of multiple hardness.

37 Claims, 6 Drawing Sheets

U.S. PATENT DOCUMENTS

| | | | | |
|---|---|---|---|---|
| 5,644,956 | A | 7/1997 | Blackman et al. | 76/108.2 |
| 5,695,019 | A | 12/1997 | Shamburger, Jr. | 175/333 |
| 5,697,462 | A | 12/1997 | Grimes et al. | 175/374 |
| 5,709,278 | A | 1/1998 | Crawford | 175/374 |
| 5,746,280 | A | 5/1998 | Scott et al. | 175/374 |
| 5,752,573 | A | 5/1998 | Scott et al. | 175/374 |
| 5,755,301 | A | 5/1998 | Love et al. | 175/426 |
| 5,813,485 | A | 9/1998 | Portwood | 175/430 |
| 5,819,861 | A | 10/1998 | Scott et al. | 175/371 |
| 5,833,020 | A | 11/1998 | Portwood et al. | 175/331 |
| 5,839,526 | A | 11/1998 | Cisneros et al. | 175/431 |
| 5,881,828 | A | 3/1999 | Fischer et al. | 175/374 |
| 5,887,655 | A | 3/1999 | Haugen et al. | 166/298 |
| 5,887,668 | A | 3/1999 | Haugen et al. | 175/79 |
| 5,890,550 | A | 4/1999 | Swadi et al. | 175/374 |
| 5,915,486 | A | 6/1999 | Portwood et al. | 175/374 |
| 5,967,245 | A | 10/1999 | Garcia et al. | 175/374 |
| 6,029,759 | A | 2/2000 | Sue et al. | 175/374 |
| 6,053,263 | A | 4/2000 | Meiners | 175/331 |
| 6,059,054 | A | 5/2000 | Portwood et al. | 175/430 |
| 6,202,752 | B1 | 3/2001 | Kuck et al. | 166/298 |
| 6,241,034 | B1 | 6/2001 | Steinke et al. | 175/331 |
| 2001/0004026 | A1 * | 6/2001 | Lockstedt et al. | 175/431 |
| 2005/0023043 | A1 * | 2/2005 | Tufts | 175/374 |

* cited by examiner

BLUNT FACED CUTTER ELEMENT AND ENHANCED DRILL BIT AND CUTTING STRUCTURE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention relates generally to earth-boring bits used to drill a borehole for the ultimate recovery of oil, gas or minerals. More particularly, the invention relates to rolling cone rock bits and to an improved cutting structure and cutter element for such bits.

2. Background Information

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Because drilling costs are typically thousands of dollars per hour, it is thus always desirable to employ drill bits which will drill faster and longer and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP.

A typical earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore sometimes referred to as rolling cones.

The borehole is formed as the gouging and scraping or crushing and chipping action of the rotary cones remove chips of formation material which are carried upward and out of the borehole by drilling fluid which is pumped downwardly through the drill pipe and out of the bit. The earth disintegrating action of the rolling cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are commonly known as "steel tooth bits." In each instance, the cutter elements on the rotating cone cutters break up the formation to form new borehole by a combination of gouging and scraping or chipping and crushing.

The shape and positioning of the cutter elements (both steel teeth and tungsten carbide inserts) upon the cone cutters greatly impact bit durability and ROP and thus, are critical to the success of a particular bit design.

The inserts in TCI bits are typically positioned in circumferential rows on the rolling cone cutters. Most such bits include a row of inserts in the heel surface of the rolling cone cutters. The heel surface is a generally frustoconical surface and is configured and positioned so as to align generally with and ream the sidewall of the borehole as the bit rotates.

Conventional bits typically include a circumferential gage row of cutter elements mounted adjacent to the heel surface but oriented and sized in such a manner so as to cut the corner of the borehole. Conventional bits also include a number of additional rows of cutter elements that are located in circumferential rows disposed radially inward or in board from the gage row. These cutter elements are sized and configured for cutting the bottom of the borehole, and are typically described as inner row cutter elements.

For the most part, inner row inserts in TCI bits have generally been one of two general shapes. One insert typically employed in an inner row may generally be described as a "conical" insert, one having a cutting surface that tapers from a cylindrical base to a generally rounded apex. Such an insert is shown, for example, in FIG. 4A-C in U.S. Pat. No. 6,241,034. Another common shape for an insert for use in inner rows is what generally may be described as a "chisel" shaped. Rather then having the rounded apex of the conical insert, a chisel insert generally includes two generally flattened sides or flanks that converge and terminate in an elongate crest at the terminal end of the insert. The chisel element may have rather sharp transitions where the flanks intersect the more rounded portions of the cutting surface, as shown, for example, in FIGS. 1–4 in U.S. Pat. No. 5,172,779. In other designs, the chisel insert may be contoured so as to eliminate sharp transitions and to present a more rounded cutting surface as shown in FIGS. 3A–D in U.S. Pat. No. 6,241,034. For various applications, the apex in the conventional conical insert and the crest of the conventional chisel insert may be offset from the central axis of the cutter element as shown, for example, in U.S. Pat. No. 4,334,586.

In general, it has been understood that, as compared to a conical inset, the chisel shaped insert provides a more aggressive cutting structure that removes formation material at a faster rate for as long as the cutting structure remains intact. For this reason, in soft formations, chisel shaped inserts are frequently preferred for bottom hole cutting.

Despite this known advantages of chisel shaped inserts, however, such cutters have shortcomings when it comes to drilling in harder formations. In particularly, in hard formations, the relatively sharp cutting edges and corners of the chisel endure high stresses that may lead to chipping and ultimately breakage of the insert. By contrast, conical inserts, having a more rounded and less aggressive shaped cutting surface, withstand harder formations much better than do chisel inserts. Unfortunately, conical inserts suffer from the shortcoming that they are slower to remove formation when drilling in soft formations as compared to a chisel insert. Accordingly, because of these differences, compromises in the cutting structure of a bit typically must be made based on the type of formation expected. Such compromises may be of little significance in the instances where the formations to be encountered are well known. For example, where the interval to be drilled is known to be composed of only soft formation, it is unimportant that a chisel insert could not withstand a harder formation.

Unfortunately, in many locations, the formation hardness cannot be predicted with such certainty. For example, it is common in certain locations to encounter layers of extremely hard rock interspersed within a long interval of relatively soft formation. In these instances, the driller is faced with a difficult problem. Because of their greater speed when drilling in soft formations, it is desirable to use a cutting structure having a chisel shaped inserts; however, when a layer of hard formation is encountered, often at unpredictable depths, the chisel shaped inserts will quickly be ruined such that the bit's ROP will drop dramatically, as for example, from 80 feet per hour to less than 10 feet per hour. Once the cutting structure is damaged and the rate of penetration reduced to an unacceptable rate, the drill string must be removed in order to replace the drill bit. As mentioned, this "trip" of the drill string is extremely time consuming and expensive to the driller.

On the other hand, if the driller were to employ a bit having a cutting structure of conical shaped inserts, a cutting structure that will better survive drilling through the layers of hard formation, the bit's rate of penetration while drilling the soft formation may be intolerably low. As will be understood then, there remains a need in the art for a cutter element and cutting structure that will provide a high rate of penetration when drilling in soft formation, yet be durable enough to withstand encounters with stringers of hard formation, and that will provide an acceptable ROP through both the hard and soft formation.

Another known phenomena detrimental to drill bit life and rate of penetration is a wear phenomena that tends to wear and flatten the cutter element on the side generally facing the borehole wall. As this wear occurs, greater side wall forces are imparted on the bit which tends to lead to bit instability and bit wobble which, in turn, tend to cause the bit to deviate from the intended drilling path and to place greater demands and stresses on the bearings. Furthermore, as the surface of the inserts facing the borehole wall tends to wear toward the center of the insert, the insert becomes sharper and more likely to chip and ultimately to break.

Thus, it would also be desirable to provide a cutter element shaped to resist such off center wear and, when such wear nevertheless does occur, to resist the tendency for the cutter element to break.

SUMMARY OF THE PREFERRED EMBODIMENTS OF THE INVENTION

According, there is provided herein a generally blunt faced cutter element for use in a rolling cone drill bit. The cutter preferably includes a continuously contoured cutting surface terminating in a generally rounded apex that is offset from the cutter element central axis. The cutter includes a first face that is flatter or more blunt than the second face on the opposite side of the cutting surface. Preferably, the cutter is symmetrical about a plane that passes through the central axis of the cutter and that bisects the first and second cutting face. In this preferred embodiment, the first face includes a wider cutting profile than the second face, and the cutting surface includes a convex or bowed surface in every longitudinal profile. The wider first face provides a substantial cutting profile, similar to that of a similarly sized chisel shaped cutter; however, due to the continuous contoured cutting surface, the regions of high stress, a potential cause of breakage, are reduced or eliminated.

It is preferred that the cutters be disposed in circumferential rows in the cone cutters of a drill bit. In a first arrangement, the generally flatter and wider first face is disposed in the outermost inner row of the cone cutter, and is oriented such that the first face faces the borehole wall when the cutter is in a position furthest from the bit axis. In this manner, the outermost row of inner row cutter elements provide a relatively broad face to resist off center wear, and to reduce the resultant bit whirl that may be fostered or caused by off center wear occurring to the cutter elements in these locations.

The cutter may also be employed in other rows in the cone cutter. For example, depending upon the drilling application, the cutter may be positioned in one or more inner rows and oriented such that its broader and flatter first surface is the first portion of the cutting surface that engages the borehole bottom. In this orientation, the cutter may provide an improved cutting structure to the drill bit enabling it to drill through soft formations with high ROP. In addition, the shape of the cutting surface provides enhanced resistance to insert breakage when stringers of hard formations are encountered by the bit. Thus, this embodiment provides both for high ROP when drilling in soft formation and enhanced durability to withstand encounters with hard formation.

In these ways, these embodiments of the present invention comprises a combination of features and advantages which enable it to overcome various shortcomings of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiments of the present invention, reference will now be made to the accompanying drawings, wherein.

DETAILED DESCRIPTION OF THE PREFERRED EMBODIMENT

Figure 1:
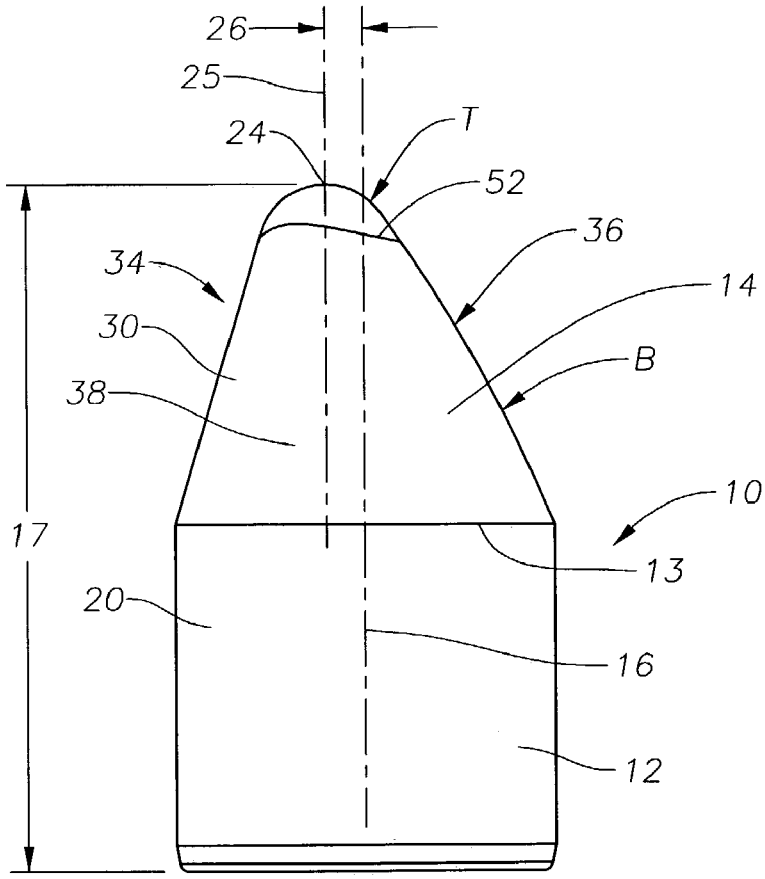
FIG. 1 is a side elevation view of a cutter element made in accordance with the present teachings.
Figure 2:
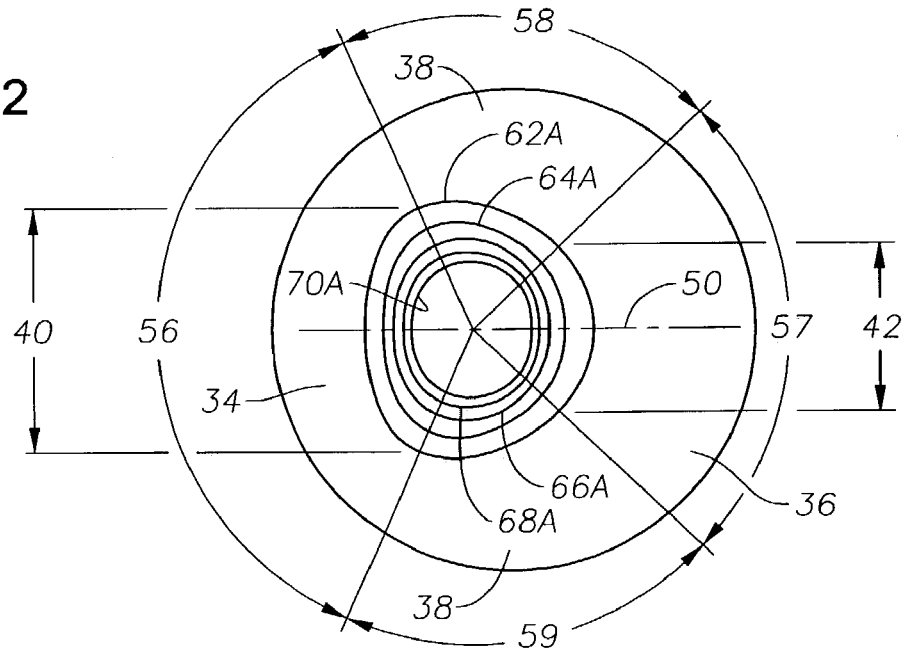
FIG. 2 is a top view of the cutter element shown in FIG. 1.
Figure 3:
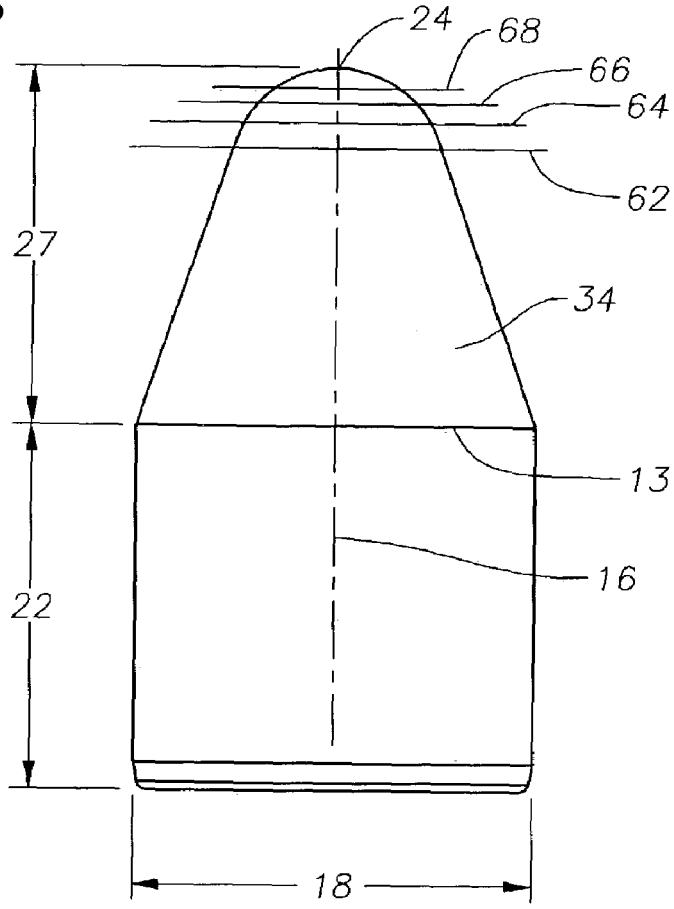
FIG. 3 is a front elevation view of the cutter element shown in FIG. 1.

Referring to FIGS. 1–3, cutter element 10 includes a generally cylindrical base portion 12 and a cutting portion 14 extending from base 12. Cutter element 10 generally has an overall length 17. Base portion 12 includes a central axis 16, a generally cylindrical side surface 20 having diameter 18 and length 22. Base 12 joins cutting portion 14 at intersection 13.

Cutting portion 14 includes a continuously contoured cutting surface 30 extending from intersection 13 a distance 27 and terminating in a generally rounded or spherical apex 24. As used herein, the term "continuously contoured" refers to surfaces that can be described as having continuously curved surfaces that are free of relatively small radii (typically less than 0.08 inches) that are conventionally used to break sharp edges or round off transitions between adjacent distinct surfaces. Apex 24 includes apex axis 25 that is parallel to but offset from base axis 16 by an offset distance 26. The dimension of offset 26 may be expressed as a percentage of the diameter 18 of insert base 12. It is preferred that the offset be within the range of 5% to 25% of the diameter 18, and, more particularly, between approximately 7% and 10% of the insert base diameter 18.

As best shown in FIG. 2, contoured cutting surface 30 may generally be described as including forward facing or front face 34, a back face 36 opposite front face 34, and a pair of transition surfaces 38 extending between the front and back faces. The cutting surface 30 preferably is symmetrical about a plane 50 that passes through base axis 16 and apex axis 25 and that generally bisects front face 34 and rear face 36. Front face 34 and back face 36 are generally coextensive with that portion of cutting surface 30 defined by angles 56 and angle 57, respectively. Transition surfaces 38 are generally coextensive with that portion of cutting surface 30 defined by angles 58, 59. Preferably, angle 56 of front face 34 encompasses approximately 120 degrees of cutting surface 30, and angle 57 of rear face 36 encompasses approximately 80 degrees. Angles 58, 59 of transition surfaces 38 each extend about approximately 80 degrees of the cutting surface 30 in this preferred embodiment.

As best shown in FIG. 1, cutting surface 30 preferably includes a slight bow or convex shape in every longitudinal profile view and in every cross sectional view where the section is taken longitudinally through apex axis 25. This convex shape is achieved by employing a top radius T and blending it with a bow radius B in order to smoothly contour the cutting surface shape from apex 24 to intersection 13. Curve 52 in FIG. 1 generally represents the location along cutting surface 30 at which the top radius T and bow radius B are blended together to form the preferred continuously contoured cutting profile that is free from abrupt changes in radius. The contours and radii describing preferred cutting surface 30 may best be described with reference to FIG. 4 and Table I below, however other top radii T and bow radii B may be employed.

TABLE I

| CURVE | TOP RADIUS | BOW RADIUS |
|---|---|---|
| A | T | B |
| B | 1.04 T | 1.06 B |
| C | 1.15 T | 1.14 B |
| D | 1.32 T | 1.23 B |
| E | 1.55 T | 1.35 B |
| F | 1.86 T | 1.48 B |
| G | 1.96 T | 1.69 B |
| H | 1.69 T | 1.58 B |
| I | 1.43 T | 1.61 B |
| J | 1.34 T | 1.45 B |

Figure 4:
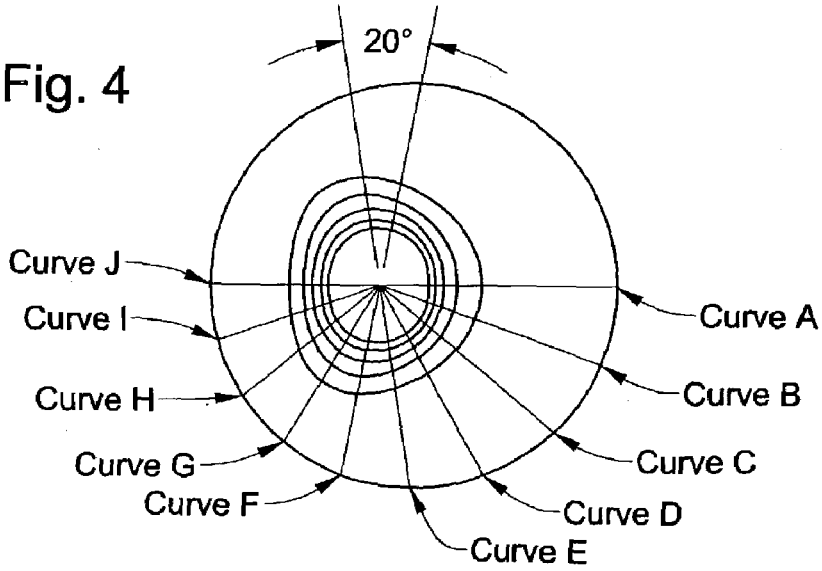
FIG. 4 is another top view of the cutter element of FIG. 1 showing various curves on the cutter element surface that correlate with data in Table I.

As shown in FIG. 4, curves A through J designate profiles of the cutting surface taken every 20 degrees along cutting surface 30 from curve A to curve J. As shown in Table I above, both the top radius T and bow radius B are their smallest at curve A. Top radius T increases through curve G where T has its greatest radius. Top radius T decreases from curve G through curve J. Bow radius B increases from curve A through curve G where it is at its maximum. Bow radius B decreases from curve G to curve H, but then increases from curve H through curve I, and then decreases again from curve I to curve J.

Cutter element 10 defined by such continuous curves presents a continuously contoured cutting surface 30 having a relatively flat or blunt front cutting face 34 and a more rounded rear cutting face 36. In this preferred configuration, front face 34 may be said to be flatter or more blunt relative to rear cutting face 36. As used herein, where a first portion of a cutting surface is described as flatter or more blunt than another portion of the cutting surface, what is meant is that in the closed figure formed by the intersection of the cutting surface and a plane that is perpendicular to the central axis 16 of the cutter element, the radius of curvature of the first portion of the closed figure is greater than the radius of curvature of the second portion.

Referring again to FIG. 3, planes 62, 64, 66, 68, which are perpendicular to apex axis 25 and insert axis 16 and that pass through the cutting surface 30, will generally form the cross-sectional closed FIGS. 62A, 64A, 66A and 68A, respectively, as shown in FIG. 2. A cross section taken above plane 68 (FIG. 3) through the generally spherical apex 25 will be substantially circular, as represented by closed FIG. 70A in FIG. 2. These cross sectional areas or closed figures likewise illustrate the generally flattened or blunt front-facing surface 34 as compared to the more rounded rear facing surface 36. Also shown in FIG. 2, front facing surface 34 includes a cutting profile width 40 that is greater than the cutting profile width 42 of rear face 36. In this manner, when insert 10 is positioned in a rolling cone cutter such that front face 34 is the first portion of the cutting surface 30 to engage the formation, rounded back face 36 may be said to be hidden or protected by virtue of it being narrower and falling within the cutting profile width 40 of front face 34 (when the cutting profiles are viewed as rotated into a single plane).

Cutter element 10 may be employed advantageously in various locations in the rolling cone cutters of a drill bit. The location and orientation of cutter element 10 may be varied as is necessary or desirable to achieve a particular result.

Figure 5:
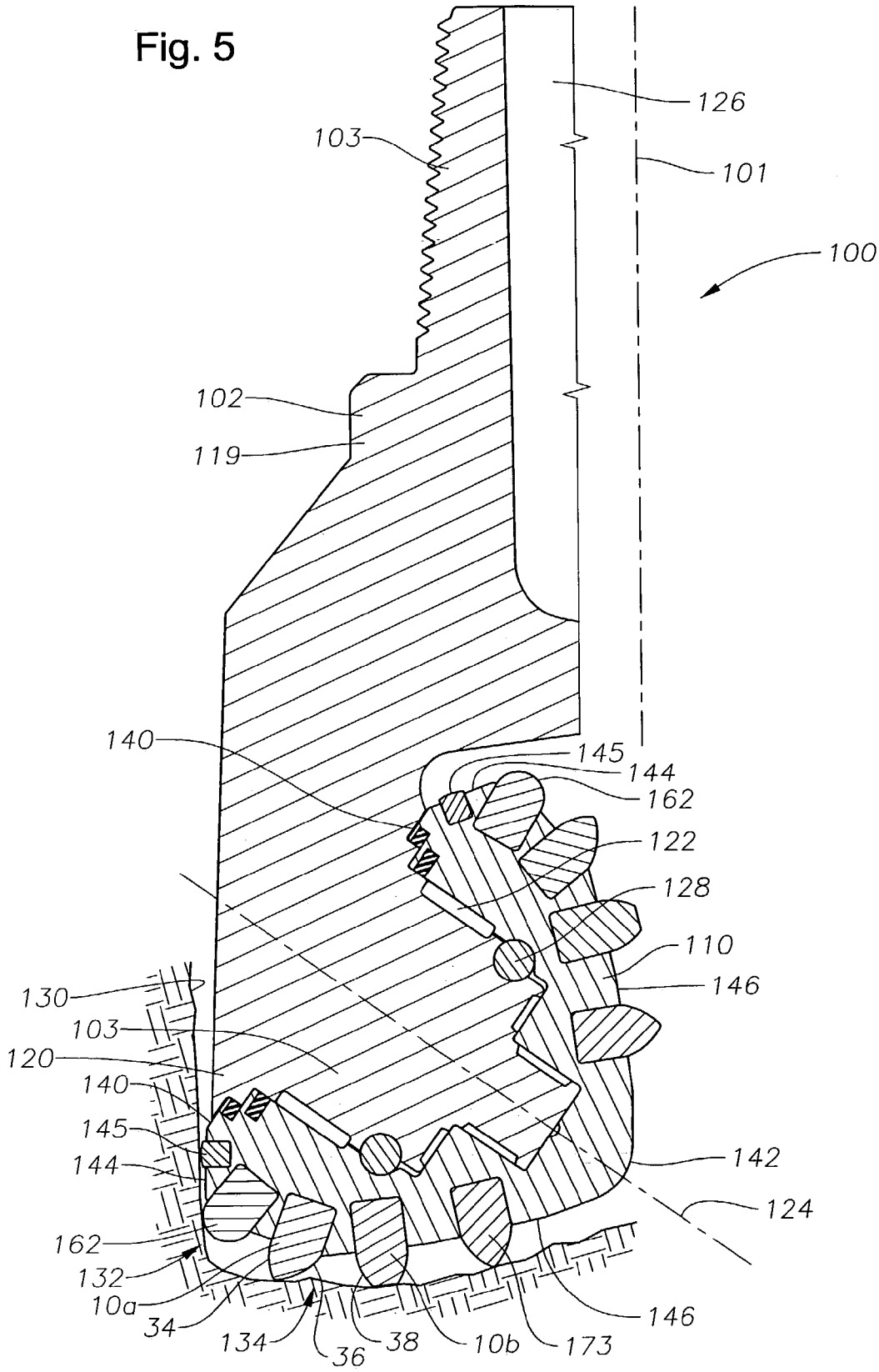
FIG. 5 is a partial section view taken through one leg and one rolling cone of a rolling cone drill bit incorporating the cutter element of FIG. 1-4.

Referring now to FIG. 5, an earth-boring bit 100 is shown to include a bit central axis 101 and a bit body 102 having a threaded pin 103 on its upper end for securing the bit to the drill string (not shown). Bit 100 has a cutting diameter as defined by three rolling cone cutters 110, 111, 112, (only cone cutter 110 being shown in FIG. 5). Each cutter 110, 111, 112 is rotatably mounted on a bearing shaft 103 that depends from the bit body 102. Bit body 102 is composed of three sections or legs 119 (one shown in FIG. 5) that are welded together to form bit body 102. Bit 100 further includes a plurality of nozzles that are provided for directing drilling fluid toward the bottom of the borehole and around cone cutters 110, 111, 112, and includes lubricant reservoirs that supply lubricant to the bearings of each of the cone cutters, such structures being omitted from the figures for clarity. Bit legs 119 include a shirttail portion 120 that serves to protect the cone bearings and seals from damage caused by cuttings and debris entering between the leg 119 and its respective cone cutter.

Each cutter 110, 111, 112 is rotatably mounted on a pin or journal 122, with an axis of rotation 124 oriented generally downwardly and inwardly toward the center of the borehole. Drilling fluid is pumped from the surface through fluid passage 126 where it is circulated through internal passageways (not shown) to the nozzles and out of the bit. Each cone cutter 110, 111, 112 is secured on pin 122 by locking balls 128. The borehole created by bit 100 includes sidewall 130, corner portion 132 and bottom 134.

Cone cutters 110–112 are substantially similar such that a description of one such cone cutter 110 will be adequate to describe the structure and operation of cone cutters 111, 112 as well. Principally, cone cutters 111, 112 differ from cone cutter 110 (and from each other) in the number and placement of cutter elements, as described in more detail below.

Figure 7:
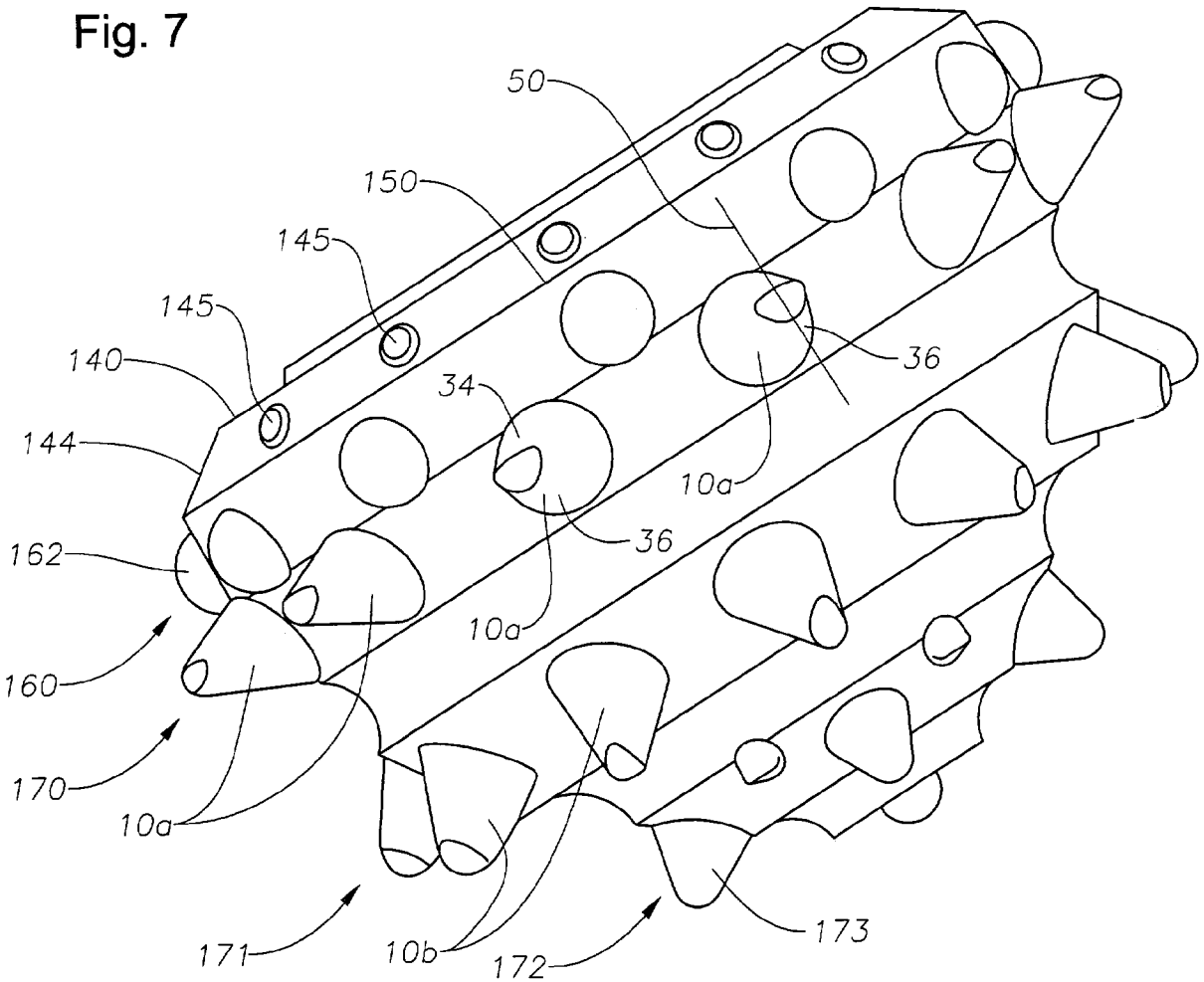
FIG. 7 is a perspective view of one of the cone cutters shown in FIG. 6.

Referring still to FIG. 5 and to FIG. 7, cone cutter 110 includes a backface 140 and nose portion 142. Cutter 110 further includes a frustoconical surface 144 adjacent to back face 140 that is adapted to retain cutter elements 145 that scrape or ream the sidewall 130 of the borehole as the cone cutter rotates about the borehole bottom. Frustoconical surface 144 will be referred to herein as the "heel" surface of cone cutters 110–112, it being understood, however, that the same surface may be sometimes referred to by others in the art as the "gage" surface of a rolling cone cutter.

Extending between heel surface 144 and nose 142 is a generally conical surface 146 adapted for supporting cutter elements that gouge or crush the borehole bottom 134 as the cone cutters 110–112 rotate about the borehole. Frustoconical heel surface 144 and conical surface 146 generally converge in a circumferential edge or shoulder 150 (FIG. 7).

Figure 6:
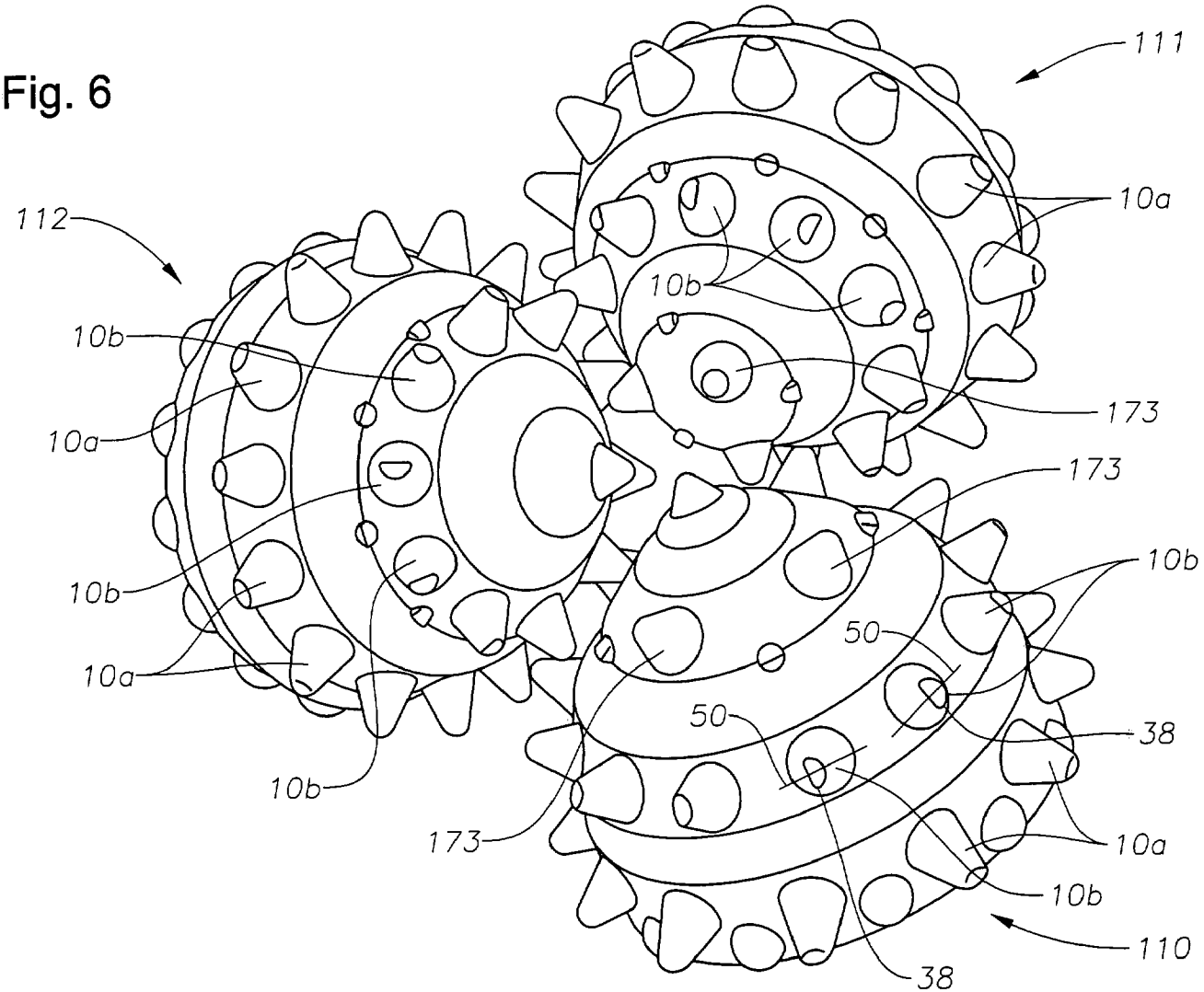
FIG. 6 is a perspective view of the rolling cone bit of FIG. 5 as viewed from the bottom of the borehole.

As best shown in FIGS. 5 and 6, cone cutters 110–112 each include a circumferential gage row 160 of inserts 162. Inserts 162 may be rounded or domed shaped or have other shaped cutting surfaces. Cone cutters 110–112 each include a plurality of inner row cutter elements 10, structured as previously described and retained in the cone cutter in a series of spaced, circumferential inner rows 170, 171, 172. In FIG. 7, draftsman's license has been employed in order to show the relative spacing of inserts in inner rows 170, 171 and 172, it being understood that a plane through the cone cutter 110 and its axis 124 will not bisect a cutter element in each inner row 170, 171, 172 due to the staggered nature of the inserts from one row to the next, best shown in FIG. 6.

Cone cutters 110–112 each include radially outermost row 170 of inner row cutters 10*a*. In row 170, cutter elements 10*a* are oriented and retained in the cone such that the blunt front face 34 faces the borehole sidewall 130 when the cutter element is in the position that places it furthest from the bit axis (and closest to the borehole wall). Cone 110 is shown in isolation in FIG. 7 wherein the orientation of inserts 10*a* in inner row 170 is best shown. In this orientation, the plane of symmetry 50 of insert 10*a* is substantially perpendicular to back face 140 of cone cutter 110.

Referring again to FIGS. 5 and 6, cone cutters 110–112 also each include a second inner row 171 having a plurality of inserts 10*b*; however, in inner row 171, the blunt front face 34 is oriented so as to face the direction of rotation of the respective cone cutter. In row 171, the front face 34 of cutter elements 10*b* are oriented 90 degrees with respect to the orientation of front face 34 of cutter elements 10*a* in the outermost inner row 170. Cone cutters 110, 111, include a third inner row 172 which, in this embodiment, is formed by conventional conical inserts 173. If desired, row 172 may instead be formed by inserts 10 and, in such case, would preferably have their front face 34 oriented in the direction of cone rotation, as with inserts 10*b* in inner row 171.

Figure 8:
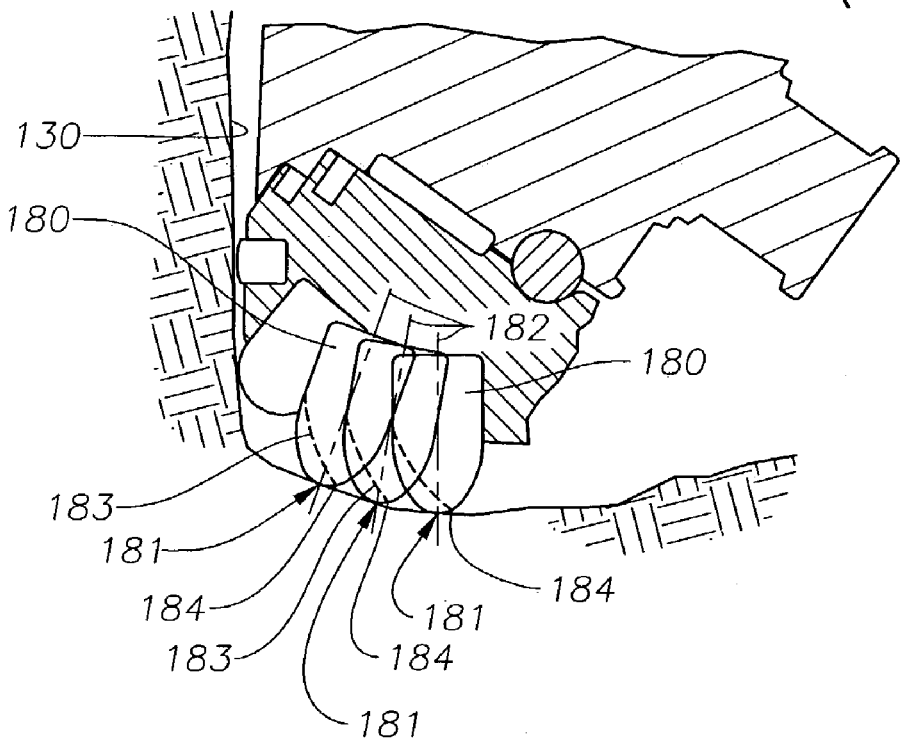
Fig. 8 (Prior Art)
FIG. 8 is a schematic view, partly in cross section, of a portion of a conventional roller cone bit having conical shaped inserts in its outermost inner rows shown rotated into a single profile.

Referring momentarily to FIG. 8, a conventional prior art rolling cone bit is shown in cross section in a view in which the cutter elements of all three cone cutters are rotated into a single profile. In this example, the inserts 180 in each of the inner rows of cutter elements are generally conically shaped and, prior to wear occurring, each has spherical apex or cutting tip 181 aligned with its axis element 182. In many formations, these inserts 180 have tended to wear rapidly on the side of the cutting surface facing the borehole wall 130 and, because of such wear, have tended to wear into the shape shown in phantom by the dashed line 183. The detrimental off center wear such as shown in FIG. 8 is typically encountered when a bit is used in a directional drilling assembly employing a downhole mud motor. Once such wear occurred, the cutting surface of the insert 180 became shaper than the original concial shape. This shaper or more brittle insert geometry makes the insert 180 more susceptible to chipping and breakage. Furthermore, upon taking the sharper shape due to this off center wear, the newly formed peak or apex 184 essentially was moved to a position generally in board of the cutter element axis 182 (toward the center of the borehole and toward bit axis 11). Because there was less insert material on the in board side of the cutter element 180 to resist the forces imposed by the borehole side wall 130 onto the newly formed apex 184, this type of off center wear lead to an increase in insert breakage and lessened the useful life of the bit.

Figure 9:
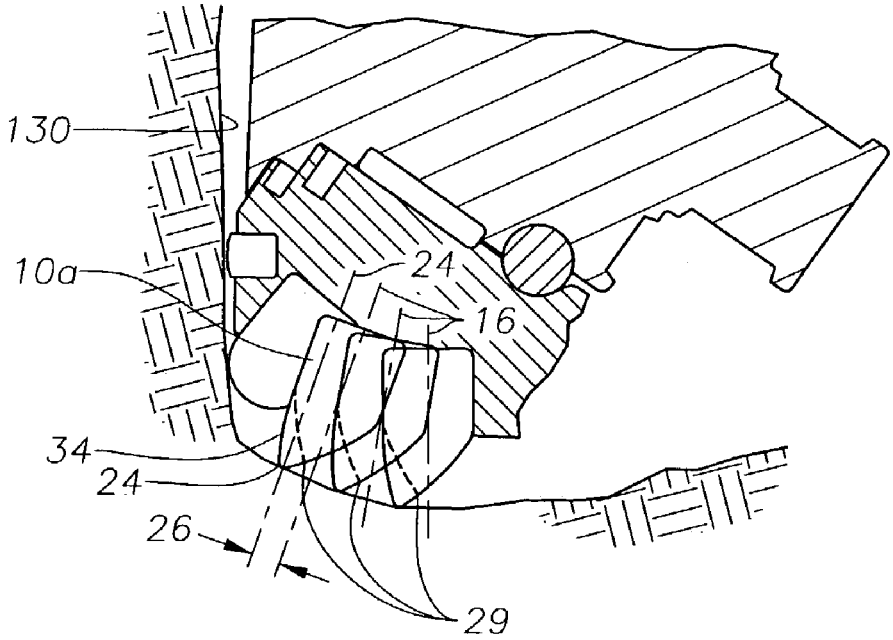
FIG. 9 is a schematic view, partly in cross section, of a portion of the cone cutter shown in FIG. 7 with the cutter elements shown rotated into a single profile.

As discussed above with respect to FIGS. 5–7, in such formations, it is advantageous to employ cutter element 10*a* in row 170 with front face 34 oriented to face the borehole sidewall 130 so as to better resist the off center wear. Referring momentarily to FIG. 9, bit 100 is shown in a profile view having all inserts 10*a* on cones 110–112 shown rotated into a single profile. As understood then from reference to FIGS. 6 and 9, each of the cutter elements 10*a* in the radially outermost rows 170 on cone cutters 110–112 are oriented to have their front face 34 generally facing the borehole sidewall. The relatively blunt front facing surface 34 is generally wider than the cutting profile of a similarly-sized conventional conical insert (such as insert 180 in FIG. 8) such that, by presenting the broadened face 34 towards the borehole sidewall 130, insert 10*a* is better able to resist the off center wear experienced by the inserts shown in FIG. 8 due, in part, to having a larger surface area opposing the sidewall forces. Furthermore, because the apex 24 of insert 10*a* is offset from the cutter axis 16 in its unworn condition, and because the offset 26 is in the direction facing the borehole sidewall as insert 10*a* is employed in inner row 170 (FIGS. 5,9), then even as wear occurs to front face 34 such that a sharper cutting tip is formed in board from the original position of apex 24, there will still be a substantial portion of the cutter element 10*a* on the back face 36 behind the cutting tip so as to resist breakage. More specifically, as shown in FIG. 9, insert 10*a* may gradually wear into the shape as shown in phantom by dashed line 31 so as to form a new cutting tip 29. Yet, due to the original offset 26, the newly formed cutting tip 29 remains outboard of insert axis 16, such that a substantial amount of insert material remains behind cutting tip 29 to resist the forces imposed by the sidewall 130, to buttress the cutting tip 29, and thereby to resist and reduce insert breakage. The front face 34 of insert 10*a* has a generally wider cutting profile then a similarly-sized conventional conical insert and provide greater resistance to off-center wear because there is greater surface area on face 34 bearing against the borehole sidewall 130. Further, by resisting off-center wear, inserts 10*a* also provide increased resistance to bit whirl. Orienting the front face 34 towards the borehole wall 130 lessens the tendency of the borehole forces to cause bit whirl, a phenomena particularly prevalent when directional drilling with downhole motors.

Collectively, this orientation of inserts 10*a* in rows 170 reduces the amount of off center movement of the bit 100 that is caused by off center wear to the inner row cutters, slows the rate of wear on the cutters as compared to a standard conical insert and, even after substantial wear to the insert 10*a* has occurred, offers increased resistance to breakage as compared to conventional conical or chisel insert. Orienting face 34 towards the borehole wall thus provides resistance to this detrimental wear to the insert and, in turn, extends the life of the bit.

As described above, cutter elements 10*b* in next inner row 171 are, in this preferred embodiment, oriented differentially from cutter elements 10*a* in the outermost inner row 170. As best shown in FIG. 6, the transition surface 38 of cutter element 10*b* generally faces the borehole sidewall while the flattened or blunt front face 34 is oriented in the direction of cone rotation. In this arrangement, the broader front facing surface 34 will first engage the borehole bottom before the narrower more rounded rear face 36 engages the hole bottom. In this way, cutter elements 10*b* in row 171 achieve much of the benefit of a conventional chisel shaped insert when drilling in soft formations as the front face 34 is wider than a standard conical insert and therefor cuts a wider swath or groove. At the same time, where hard formations are encountered, the forward facing surface 34, with its continuously contoured cutting surface 30 and the absence of sharp stress-creating edges, is less susceptible to breakage than a conventional chisel-shaped insert. Further, because of the offset 26 of the apex 24 from the central axis 16 of the insert 10*b*, there is more support behind the front face 34 which again provides increased resistance to breakage, particularly after wear has occurred. Orienting the blunt and wider front face 34 of inserts 10*b* in rows 171 to first engage the borehole bottom maximizes the scrapping or gouging action of the cutter elements 10*b* but still maintains much of the beneficial characteristics of a conical insert when cutting in hard formations.

It is to be understood that in various preferred embodiments of the present invention, cutter elements 10 will be employed only in the outermost of the inner rows on the cone cutters. Thus, notwithstanding the description of the embodiment having cutters 10*b* in inner row 171 or in other inner rows, the benefits of resisting off-center wear can be achieved with cutter elements 10 in the outermost inner row, with conical or chisel shaped inserts or inserts of other conventional shapes in the other inner rows.

Additionally, it is to be understood that although the inserts in the innermost inner row 172 of cones 110–112 have been shown in FIG. 5-7 to be conical inserts 173, cutter elements 10 described herein could be employed in row 172 and any other row as the drilling requirements may require. Further, although cutter elements 10 have been shown in two orientations in two separate rows 170, 171, other orientations of cutter elements 10 in rows 170, 171 may be employed. Further still, cutter elements 10 may be interspersed with conventional chisel shaped inserts, conical inserts, or other conventional inserts, rather than employing cutter element 10 at every location within a given inner row.

While cutter element 10 has been shown and described to this juncture as being an insert type cutter element for use in a TCI bit, the cutter element 10 may likewise be employed as a tooth formed in a cone cutter in a steel tooth bit. Thus, the principles and advantages described above for an insert-type bit may likewise be employed and achieved in steel-tooth bits.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for a drill bit comprising:

a base having a central axis;

a cutting portion extending from said base and having a continuously contoured cutting surface terminating in a generally rounded apex, said cutting surface including:

a first face extending from said base to said apex;

a second face opposite said first face extending from said base to said apex;

a pair of transition surfaces extending between said first and second faces and between said base and said apex;

wherein said cutting portion is symmetrical about a plane containing said central axis and bisecting said first and second faces; and wherein said apex is offset a distance D from said central axis in the direction of said first face; said first face being flatter than said second face.

2. The cutter element of claim 1 wherein said apex is generally spherical.

3. The cutter element of claim 1 wherein said first face has a first cutting profile and said second face has a second cutting profile and wherein said first cutting profile is wider than said second cutting profile.

4. The cutter element of claim 1 wherein said offset is between 5 and 25 percent of the diameter of said base.

5. The cutter element of claim 1 wherein said apex is generally spherical and said offset is between 5 and 25 percent of the diameter of said base; and wherein said continuously contoured cutting surface is convex in every longitudinal profile.

6. The cutter element of claim 5 wherein said first face has a first cutting profile and said second face has a second cutting profile, and wherein said second cutting profile falls within said first cutting profile when said profiles are viewed as rotated within a single plane.

7. The cutter element of claim 1 wherein said cutting surface is outwardly bowed and includes a bow radius B as viewed in every longitudinal profile; and wherein said bow radius changes along said cutting surface from the intersection of said plane of symmetry and said second face to the intersection of said plane of symmetry and said first face, said bow radius being at its maximum at an angular position closer to said first face than said second face.

8. The cutter element of claim 7 wherein said cutting surface is outwardly bowed and includes a top radius T as viewed in every longitudinal profile; and wherein said top radius changes along said cutting surface from the intersection of said plane of symmetry and said second face to the intersection of said plane of symmetry and said first face, said top radius being at its maximum at an angular position closer to said first face than said second face.

9. The cutter element of claim 8 wherein said top radius and said bow radius are each at a maximum at the same angular position relative to the intersection of said plane of symmetry and said second face.

10. The cutter element of claim 7 wherein said bow radius at the angular position where said plane of symmetry intersects said first face is greater than said bow radius at the angular position where said plane of symmetry intersects said second face.

11. The cutter element of claim 10 wherein said top radius at the angular position where said plane of symmetry intersects said first face is greater than said top radius at the angular position where said plane of symmetry intersects said second face.

12. The cutter element of claim 1 wherein said first face is flatter than said second face at axial locations below said generally rounded apex.

13. The cutter element of claim 1 wherein a cross section of said generally rounded apex taken perpendicular to said central axis is substantially circular, said generally rounded apex being above said first and second faces.

14. A cutter element for a drill bit comprising:

a base having a central axis;

a cutting surface extending from said base and including a rounded apex offset in a first direction from said central axis, said apex being symmetrical about an apex axis that is substantially parallel to said central axis;

a forward facing cutting surface on one side of said apex axis, wherein said offset is toward said forward facing cutting surface;

a rear facing cutting surface on the opposite side of said apex axis from said forward facing cutting surface;

wherein said forward facing cutting surface is flatter than said rear facing cutting surface and has a wider cutting profile than said rear facing cutting surface.

15. The cutter element of claim 14 wherein said apex is offset from said central axis a distance that is greater than 5 percent of the diameter of said base.

16. The cutter element of claim 15 wherein said cutting surface is defined by a spherical radius at said apex.

17. The cutter element of claim 14 wherein said cutting surface is symmetrical about a plane of symmetry that passes through said central axis and said apex axis and that bisects said forward facing and rear facing cutting surfaces.

18. The cutter element of claim 14 wherein said forward facing cutting surface and said rear facing cutting surface are each convex in a profile view taken through said apex axis.

19. The cutter element of claim 18 wherein said cutting surface includes a top portion defined by a top radius and a lower portion defined by a bow radius, wherein said top radius and said bow radius are blended at their intersection so as to form a continuously contoured cutting surface; and wherein said bow radius is at a minimum at the angular position where said plane of symmetry intersects said rear facing surface, is at a maximum at an angular position that is more than 90° from the intersection of said plane of symmetry and said rear facing surface, and has an intermediate value that is between said minimum and said maximum at the angular position where said plane of symmetry intersects said front facing surface.

20. The cutter element of claim 19 wherein said top radius is at a minimum at the angular position where said plane of symmetry intersects said rear facing surface, is at a maximum at an angular position that is more than 90° from the intersection of said plane of symmetry and said rear facing surface, and has an intermediate value that is between said minimum and said maximum at the angular position where said plane of symmetry intersects said front facing surface.

21. The cutter element of claim 14 wherein said forward facing cutting surface is flatter than said rear facing cutting surface at axial locations below said rounded apex.

22. The cutter element of claim 14 wherein a cross section of said rounded apex taken perpendicular to said central axis is substantially circular, said rounded apex being above said forward facing cutting surface and said rear facing cutting surface.

23. A drill bit having a nominal gage diameter for drilling a borehole in earthen formations, said bit comprising:

a bit body having a bit axis;

at least one rolling cone cutter rotatably mounted on said bit body and having a plurality of cutter elements disposed in spaced-apart circumferential rows;

a gage row of cutter elements having cutting portions extending to full gage diameter for cutting the corner of the borehole;

a first inner row of cutter elements disposed radially inboard of said gage row for cutting the borehole bottom, said first inner row cutter elements having a base retained in said cone cutter, a central axis, and a cutting portion extending from said base;

wherein a plurality of said first inner row cutter elements have a cutting surface comprising:

a generally rounded apex;

a first face extending from said base to said apex;

a second face opposite said first face extending from said base to said apex;

wherein said first face is flatter than said second face and wherein said apex is offset a distance D from said central axis in the direction of said first face; and wherein said plurality of first inner row cutter elements are oriented in said cone so that said first face generally faces the borehole side wall when said cutter element is at its radially outermost position with respect to the bit axis.

24. The bit of claim 23 wherein all the cutter elements in said first inner row are oriented so as to have their first face generally facing said borehole side wall when said cutter element is at its radially outermost position with respect to the bit axis.

25. The bit of claim 23 further comprising:

a second inner row of cutter elements disposed radially inboard of said first inner row, said second inner row cutter elements having a base retained in said cone cutter, a central axis, and a cutting portion extending from said base;

wherein a plurality of said second inner row cutter elements have a cutting surface comprising:

a generally rounded apex;

a first face extending from said base to said apex;

a second face opposite said first face extending from said base to said apex;

a pair of transition surfaces extending between said first and second faces and between said base and said apex;

wherein said first face is flatter than said second face and wherein said apex is offset a distance D from said central axis in the direction of said first face; and wherein said plurality of second inner row cutter elements are oriented in said cone so that one of said transition surfaces generally faces the borehole side wall when said cutter element is at its radially outermost position with respect to the bit axis.

26. The bit of claim 25 wherein all said cutter elements in said first inner row are oriented so as to have their first face generally facing the borehole side wall when said first inner row cutter element is at its radially outermost position with respect to the bit axis; and wherein all the cutter elements in said second inner row are oriented in said cone so that one of said transition surfaces generally faces the borehole side wall when said second inner row cutter element is at its radially outermost position with respect to the bit axis.

27. The bit of claim 25 wherein said first face of said first and second plurality of cutter elements has a cutting profile width that is greater than the cutting profile width of said second face.

28. A drill bit with predetermined gage diameter for drilling a borehole in earthen formations comprising:

a body with a bit axis;

at least one rolling cone cutter rotatably mounted on said bit body and adapted to rotate in a predetermined cutting direction;

a gage row of cutter elements on said cone cutter having cutting portions extending to full gage diameter for cutting the corner of the borehole;

a first inner row of cutter elements radially in board of said gage row, said first inner row cutter elements having a central axis and a cutting portion extending from the cone cutter, said cutting portion including a generally rounded apex, a first face extending from the cone cutter to said apex, a second face opposite said first face and extending from said cone cutter to said apex, said first face being flatter than said second face and said apex being offset a predetermined distance from said central axis in a direction of said first face, said first inner row cutter elements oriented in said cones such that said first face generally faces the borehole sidewall when said cutter element is at its radially-outermost position with respect to the bit axis.

29. The drill bit of claim 28 further comprising a second inner row of cutter elements radially in board of said first inner row of cutter elements, said second inner row cutter elements having a central axis and a cutting portion extending from the said cone cutter, said cutting portion including a generally rounded apex, a first face extending from said cone cutter to said apex, a second face opposite said first face extending from said cone cutter to said apex, wherein said first face of said second inner row cutter elements, is flatter than said second face of said second inner row cutter elements and wherein said apex of said second inner row cutter element is offset a distance from said central axis in a direction of said first face.

30. The drill bit of claim 29 wherein said second inner row cutter elements are oriented such that said first face of said second inner row cutter element generally faces in said predetermined cutting direction.

31. The drill bit of claim 30 wherein said first face of said second inner row cutter elements is wider than second face of said second inner row cutter elements.

32. The drill bit of claim 30 further comprising a third inner row of cutter elements radially in board of said second inner row of cutter elements, said third inner row cutter elements having a central axis and a cutting portion extending from said cone cutter, said cutting portion including a generally rounded apex, a first face extending from said cone cutter to said apex, a second face opposite said first face extending from said cone cutter to said apex, wherein said first face of said third inner row cutter elements is flatter said second face of said third inner row cutter elements, and wherein said apex of said third inner row cutter elements is offset a distance from said central axis in a direction of said first face; and wherein said third inner row cutter elements are oriented such that said first face of said third inner row cutter element generally faces in said pre-determined cutting direction.

33. A drill bit having a nominal gage diameter for drilling a borehole in earthen formations, said bit comprising:

a bit body having a bit axis;

at least one rolling cone cutter rotatably mounted on said bit body and having a plurality of cutter elements disposed in spaced-apart circumferential rows;

a gage row of cutter elements having cutting portions extending to full gage diameter for cutting the corner of the borehole;

a plurality of first inner row of cutter elements disposed radially inboard of said gage row for cutting the borehole bottom, said plurality of first inner row cutter elements having a base retained in said cone cutter, a central axis, and a cutting portion having a cutting surface extending from said base and terminating in a generally rounded apex, said cutting surface including:

a first face extending from said base to said apex;

a second face opposite said first face extending from said base to said apex;

wherein said cutting portion is symmetrical about a plane containing said central axis and bisecting said first and second faces; and wherein said apex is offset a distance D from said central axis in the direction of said first face; said first face being flatter than said second face; and wherein said plurality of first inner row cutter elements are oriented in said cone so that said first face generally faces the borehole side wall when said cutter element is at its radially outermost position with respect to the bit axis.

34. The drill bit of claim 33 wherein said cutting surface of said plurality of first inner row cutter elements is outwardly bowed and includes a bow radius B as viewed in every longitudinal profile; and wherein said bow radius changes along said the cutting surface from the intersection of said plane of symmetry and said second face to the intersection of said plane of symmetry and said first face, said bow radius being at its maximum at an angular position closer to said first face than said second face.

35. The drill bit of claim 34 wherein said cutting surface of said plurality of first inner row cutter elements is outwardly bowed and includes a top radius T as viewed in every longitudinal profile; and wherein said top radius changes along said cutting surface from the intersection of said plane of symmetry and said second face to the intersection of said plane of symmetry and said first face, said top radius being at its maximum at an angular position closer to said first face than said second face.

36. The drill bit of claim 35 wherein all the cutter elements in said first inner row are oriented so as to have their first face generally facing said borehole side wall when said cutter element is at its radially outermost position with respect to the bit axis.

37. A cutter element for a drill bit comprising:

a base having a central axis;

a cutting portion extending from said base and having a continuously contoured cutting surface terminating in a generally rounded apex, said cutting surface including:

a first face extending from said base to said apex;

a second face opposite said first face extending from said base to said apex;

a pair of transition surfaces extending between said first and second faces and between said base and said apex; and wherein said apex is offset a distance D from said central axis in the direction of said first face; said first face being flatter than said second face.

* * * * *